US009170519B2

(12) United States Patent
Son et al.

(10) Patent No.: US 9,170,519 B2
(45) Date of Patent: Oct. 27, 2015

(54) COLOR IMAGE FORMING APPARATUS AND CONTROL METHOD THEREOF TO DETERMINE WHETHER TO TRANSFER TONER IMAGE TO A TRANSFER BELT

(75) Inventors: Jung Woo Son, Seoul (KR); Suk Goo Kim, Namyangju-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 510 days.

(21) Appl. No.: 13/542,832

(22) Filed: Jul. 6, 2012

(65) Prior Publication Data

US 2013/0016985 A1 Jan. 17, 2013

(30) Foreign Application Priority Data

Jul. 13, 2011 (KR) ..... 10-2011-0069444

(51) Int. Cl.

| | |
|---|---|
| ***G03G 15/01*** | (2006.01) |
| ***G03G 15/00*** | (2006.01) |
| ***G03G 15/16*** | (2006.01) |

(52) U.S. Cl.

CPC ..... *G03G 15/0189* (2013.01); *G03G 15/1615* (2013.01); *G03G 15/5054* (2013.01)

(58) Field of Classification Search

CPC ..... G03G 15/0189; G03G 15/5054; G03G 15/1615

USPC ..... 399/162, 165, 40, 66, 297, 300, 301, 399/302

See application file for complete search history.

(56) References Cited

U.S. PATENT DOCUMENTS 4,683,380 A * 7/1987 Shipkowski et al. ..... 250/548
5,216,256 A * 6/1993 Kusumoto et al. ..... 250/548

* cited by examiner

*Primary Examiner* — Billy Lactaoen
(74) *Attorney, Agent, or Firm* — Staas & Halsey LLP

(57) ABSTRACT

A color image forming apparatus and a control method thereof, in which a transfer start position of a transfer belt is determined based on electric signals that correspond to a width of a position indicator provided on a transfer belt and are detectable during one rotation of the transfer belt even when noise occurs in output, thereby reducing the overall printing time.

27 Claims, 8 Drawing Sheets

COLOR IMAGE FORMING APPARATUS AND CONTROL METHOD THEREOF TO DETERMINE WHETHER TO TRANSFER TONER IMAGE TO A TRANSFER BELT

CROSS-REFERENCE TO RELATED APPLICATIONS

This application claims priority under 35 U.S.C. §119 from Korean Patent Application No. 2011-0069444, filed on Jul. 13, 2011 in the Korean Intellectual Property Office, the disclosure of which is incorporated herein by reference in its entirety.

BACKGROUND

1. Field

Embodiments of the present disclosure relate to a color image forming apparatus and a control method thereof, and more particularly, to a color image forming apparatus capable of detecting a position of a transfer belt where a toner image developed on a photoconductor is transferred and transferring the toner image from the photoconductor to the transfer belt and a control method thereof.

2. Description of the Related Art

In general, a color image forming apparatus is divided into a multipass scheme, which forms a color image by rotating a signal photoconductor several times, and a single pass scheme, which forms a color image by rotating each of a plurality of photoconductors once.

A color image forming apparatus using the multipass includes a transfer belt which is configured to form a primary transfer image by overlapping different color toner images formed on a photoconductor, and to transfer the primary transfer image to a recording medium.

In this case, the plurality of toner images are separately formed on the photoconductor by corresponding developing apparatuses and the toner images are individually transferred from the photoconductor to the transfer belt such that one toner image is disposed on top of another toner image. In order to obtain a uniform transfer image having less color deviation among different toner images colors when transferring the toner images to the transfer belt, a transfer start position of each toner image needs to be precisely controlled.

To this end, the color image forming apparatus includes a transfer position sensing apparatus configured to detect a transfer position of a transfer belt where each toner image formed on the photoconductor is transferred.

The transfer position sensing apparatus includes a position sensing hole, which is formed on a transfer start position of the transfer belt and serves as a position indicator, and a detection sensor, which includes a light emitting portion and a light receiving portion that are disposed along the moving path of the position sensing hole opposite each other with respect to the position sensing hole. The sensor emits a predetermined light from the light emitting portion and detects the transfer start position of the transfer belt according to whether light is received by the light receiving portion. That is, if the position sensing hole of the transfer belt, which is driven in a caterpillar manner, is disposed in a path through which light passes, the light emitted from the light emitting portion penetrates the position sensing hole and reaches the light receiving portion. Sensing such a state, the transfer start position of the transfer belt is detected.

The color image forming apparatus having such a transfer position sensing apparatus starts rotating upon generation of a print command, and the sensor generates a sensing signal through the position sensing hole formed on the transfer start position of the transfer belt.

As the sensor generates a sensing signal, the control unit determines a position of the transfer belt corresponding to the position sensing hole as a transfer start position of a first color toner image, for example, a transfer start position of a yellow toner image, and controls a laser scanning unit (referred to as 'LSU') and a yellow color developer such that a yellow toner image is formed on a position of the photoconductor corresponding to the transfer start position of the first color toner image.

As a result, an electrostatic latent image corresponding to a yellow toner image is formed on the photoconductor by a laser beam which is emitted from the LSU according to an image signal input from a personal computer, and a yellow toner is attached to the yellow electrostatic latent image formed on the photoconductor by a developing roller of the yellow color developer, so that a visible yellow toner image is developed.

Sequentially, when the transfer start position of the transfer belt for the yellow toner image reaches a transfer nip between the transfer belt and the photoconductor, a transfer bias voltage having a predetermined potential and an opposite polarity to that of the yellow toner is applied to a transfer roller. As a result, the yellow toner image formed on the photoconductor is transferred to the transfer belt by the transfer bias voltage and pressure of the transfer roller.

Thereafter, if the sensor generates a sensing signal through the position sensing hole again, the second toner image, a magenta toner image, for example, is formed on the photoconductor by the LSU and by a magenta color developer (similar to the method of forming the yellow toner image), and the magenta toner image is transferred to the yellow toner image on the transfer belt by a transfer bias voltage and by the pressure of a transfer roller when the transfer start position of the transfer belt reaches the transfer nip between the transfer belt and the photoconductor.

Similar to the method of forming the yellow toner image and the magenta toner image, a third toner image and a fourth toner image, for example, a cyan toner image and a black toner image, are formed on the photoconductor (by the LSU, a cyan color developer and a black color developer), and are transferred on the yellow toner image and on the magenta toner image.

However, such a conventional color image forming apparatus determines the transfer start position of the transfer belt for each toner image only based on a sensing signal, which is generated when the sensor detects either a front end or a rear end of the position sensing hole.

That is, since the position sensing hole is detected only based on the sensing signal either from a front end or a rear end of the position sensing hole, so noise may hinder a precise detection of the position sensing hole. Therefore, in order to precisely determine whether the position sensing hole is sensed, another sensing signal is needed, and thus the transfer belt needs to perform two rotations.

A transfer start point of time, at which a first color toner image (for example, a yellow toner image) starts to be transferred to the transfer belt, is determined according to when a print command is generated and whether the position sensing hole of the transfer belt is sensed. Accordingly, even if the print command is generated, the LSU is on hold without forming a yellow electrostatic latent image on the photoconductor until a sensing signal is generated through the position sensing hole.

In this case, if the detection of the position sensing hole is delayed, the overall print time is increased.

For example, in the case that a rotation period of a transfer belt is 3.75 seconds, if the transfer belt performs two rotations, a waiting time that a LSU waits to form a yellow electrostatic latent image is 7.5 seconds at the maximum. Accordingly, an electrostatic latent image forming time, at which a yellow electrostatic latent image is formed on the photoconductor, and a transfer start time, at which the yellow electrostatic latent image is transferred to the transfer belt, are delayed by the waiting time, so that the overall print time is increased.

SUMMARY OF THE INVENTION

The present disclosure provides a color image forming apparatus capable of rapidly and reliability determining a transfer start position of a transfer belt based on electric signals corresponding to a width of a position indicator provided on the transfer belt, and a control method thereof.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a color image forming apparatus including a position indicator, a sensor and a controller. The position indicator may be provided on a transfer belt. The sensor may be provided on a moving path of the position indicator, which moves when the transfer belt rotates, and may detect the position indicator. The controller may be configured to perform a control operation such that a transfer start position, at which a toner image is transferred from a photo conductor to the transfer belt, is determined based on a sensing signal, which represents a width of the position indicator, and a toner image is formed on the photo conductor according to the determined transfer start position.

The position indicator may include a slit or a hole formed through one side edge of the transfer belt.

The sensor may include a light passing sensor having a light emitting portion and a light receiving portion.

The sensor may output a first sensing signal when a front end of the position indicator in a rotation direction of the transfer belt is detected, and may output a second sensing signal when a rear end of the position indicator in the rotation direction of the transfer belt is detected.

The controller may determine the first sensing signal and the second sensing signal as the sensing signal, which represents the width of the position indicator, when a time interval between the first sensing signal and the second sensing signal is identical to a time corresponding to the width of the position indicator.

The controller may determine that the position indicator is detected when a time interval between the first sensing signal and the second sensing signal is identical to a time corresponding to the width of the position indicator, and determines the transfer start position of the transfer belt when it is determined that the position indicator is sensed.

The controller may determine a point of time, at which the first sensing signal is generated, or a point of time, at which the second sensing signal is generated, as the transfer start position of the transfer belt.

The controller may determine the second sensing signal as noise when a time interval between the first sensing signal and the second sensing signal is smaller than a time corresponding to the width of the position indicator.

The controller may wait until a next sensing signal is input from the sensor when the second sensing signal is determined as noise, and recognize the next sensing signal as a second sensing signal when the next sensing signal is input from the sensor.

The controller may change the second sensing signal to a first sensing signal when a time interval between the first sensing signal and the second sensing signal is larger than a time corresponding to the width of the position indicator.

After the second sensing signal is changed to the first sensing signal, the control unit may wait until a next sensing signal is input from the sensor, and recognize the next sensing signal as a second sensing signal when the next sensing signal is input from the sensor.

After the second sensing signal is changed to the first sensing signal, the control unit may determine whether the transfer belt has performed one rotation, and when a result of determination is that the transfer belt has performed one rotation, the control unit may determine the changed first sensing as a noise.

The controller alerts that the sensing of the position indicator is failed when the changed first signal is determined as noise.

The foregoing and/or other features and utilities of the present general inventive concept may also be achieved by providing a color image forming apparatus including a photo conductor, a transfer belt, a position indicator, a sensor and a controller. The photoconductor may be configured to have a toner image formed thereon. The transfer belt may be configured to deliver the toner image formed on the photo conductor such that the toner image is transferred to a recording medium. The position indicator may be provided on the transfer belt. The sensor may be provided on a moving path of the position indicator, which moves when the transfer belt rotates, and detects the position indicator. The controller may be configured to perform control such that a transfer start position, at which the toner image formed on the photo conductor is transferred to the transfer belt, is determined based on a sensing signal which represents a width of the position indicator, and a toner image is formed on the photo conductor according to the determined transfer start position.

The sensor may output a first sensing signal when a front end of the position indicator in a rotation direction of the transfer belt is detected, and may output a second sensing signal when a rear end of the position indicator in the rotation direction of the transfer belt is detected.

The controller may determine the first sensing signal and the second sensing signal as the sensing signal, which represents the width of the position indicator, when a time interval between the first sensing signal and the second sensing signal is identical to a time corresponding to the width of the position indicator.

The controller may determine that the position indicator is detected when a time interval between the first sensing signal and the second sensing signal is identical to a time corresponding to the width of the position indicator, and may determine a point of time, at which the first sensing signal is generated, or a point of time, at which the second sensing signal is generated, as the transfer start position of the transfer belt, when it is determined that the position indicator is sensed.

The controller may determine the second sensing signal as noise when a time interval between the first sensing signal and the second sensing signal is smaller than a time corresponding to the width of the position indicator, then may wait until a next sensing signal is input from the sensor when the second sensing signal is determined as a noise, and may recognize the next sensing signal as a second sensing signal when the next sensing signal is input from the sensor.

The controller may change the second sensing signal to a first sensing signal when a time interval between the first sensing signal and the second sensing signal is larger than a time corresponding to the width of the position indicator, may wait until a next sensing signal is input from the sensor, and may recognize the next sensing signal as a second sensing signal when the next sensing signal is input from the sensor.

After the second sensing signal is changed to the first sensing signal, the control unit may determine whether the transfer belt has performed one rotation, and when a result of determination is that the transfer belt has performed one rotation, the control unit may determine the changed first sensing as a noise and alerts that the sensing of the position indicator is failed.

The foregoing and/or other features and utilities of the present general inventive concept may also be achieved by providing a color image forming apparatus including a photoconductor, an exposure unit, a developing unit, a transfer belt, a position indicator, a sensor and a controller. The exposure unit may be configured to form an electrostatic latent image on the photo conductor. The developing unit may be configured to form the electrostatic latent image formed on the photo conductor to a toner image. The transfer belt may be configured to deliver the toner image formed on the photo conductor such that the toner image is transferred to a recording medium. The position indicator may be provided on a transfer belt. The sensor may be configured to sense the position indicator when the transfer belt rotates. The controller may be configured to determine whether the position indicator is detected based on a sensing signal representing a width of the position indicator, and to perform control on the exposure unit such that an electrostatic latent image is formed based on the sensing signal when a result of the determination is that the position indicator is detected.

The foregoing and/or other features and utilities of the present general inventive concept may also be achieved by providing a control method of a color image forming apparatus. A position indicator may be detected. The position indicator may be provided on a transfer belt through a sensor. A time corresponding to a width of the position indicator may be compared to a time interval between a first sensing signal, which is generated when the sensor detects a front end of the position indicator, and a second sensing signal, which is generated when the sensor detects a rear end of the position indictor. A transfer start position may be controlled accordingly. The transfer start position may represent a position, at which a toner image is transferred from a photo conductor to the transfer belt, based on a point of time the first sensing signal is generated or a point of time the second sensing signal is generated according to a result of the comparison.

The second sensing signal may be determined as noise when a result of the comparison is that the time interval between the first sensing signal and the second sensing signal is smaller than a time corresponding to the width of the position indicator, a next sensing signal may be input from the sensor when the second sensing signal is determined as noise, and the next sensing signal is recognized as a second sensing signal when the next sensing signal is input from the sensor.

In the comparing of time, a time interval between the first sensing signal and the recognized second sensing signal may be compared with the time corresponding to the position indicator.

The second sensing signal may be changed to a first sensing signal, it is determined whether the transfer belt has performed one rotation, and an alert signal is generated to indicate that the sensing of the position indicator is failed when a result of the determination is that the transfer belt has performed one rotation.

The second sensing signal may be changed to the first sensing signal when a result of the comparison is that the time interval between the sensing signal and the second signal is larger than a time corresponding to the width of the position indicator, a next sensing signal may be input from the sensor, and the next sensing signal may be recognized as a second sensing signal when the next sensing signal is input from the sensor.

In the comparing of time, a time interval between the first sensing signal and the recognized second sensing signal may be compared with the time corresponding to the width of the position indicator.

In the controlling of the transfer start position, it may be determined that the position indicator is sensed when a result of the comparison is that the time interval between the first sensing signal and the second sensing signal is identical to the time corresponding to the width of the position indicator, and the transfer start position may be controlled based on the point of time the first sensing signal is generated or the point of time the second sensing signal is generated.

In the controlling of the transfer start position, a transfer start position may be determined based on the point of time the first sensing signal is generated or on the point of time the second sensing signal is generated, in which the transfer start position represents a position, at which the toner image is transferred from the photo conductor to the transfer belt. The forming of a toner image may starts at an image forming position of the photo conductor corresponding to the determined transfer start position. The toner image formed on the photo conductor may be transferred to the transfer belt when the transfer start position of the transfer belt reaches the photo conductor.

As described above, the transfer start position of the transfer belt may be determined by use of electric signals which correspond to the width of the position indicator provided on the transfer belt. The electric signals having a time interval corresponding to the width of the position indicator may be detected during one rotation of the transfer belt so that the transfer start position of the transfer belt is reliably determined during one rotation of the transfer belt regardless a noise occurring in an output of the sensor configured to sense the position indicator, thereby preventing the overall print time from being increased.

BRIEF DESCRIPTION OF THE DRAWINGS

These and/or other features and utilities of the present general inventive concept will become apparent, and more readily appreciated from the following description of the embodiments, taken in conjunction with the accompanying drawings of which.

DETAILED DESCRIPTION

Figure 1:
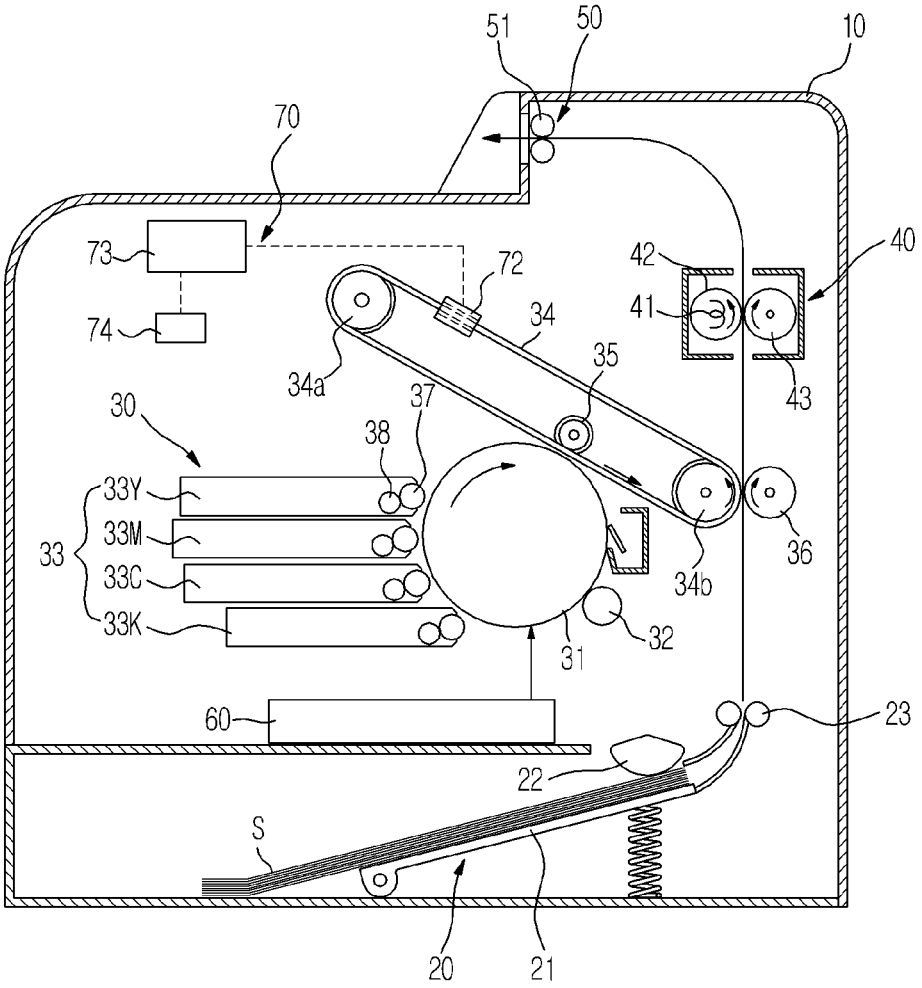
FIG. 1 is a cross sectional view illustrating a color image forming apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept while referring to the figures.

FIG. 1 is a cross sectional view illustrating an example of a color image forming apparatus.

Referring to FIG. 1, the color image forming apparatus includes a body 10 forming an external appearance, a paper feeding unit 20, a developing unit 30, a fusing unit 40, a paper discharging unit 50, an exposure unit 60, and a transfer position control unit 70. The paper feeding unit 20, the developing unit 30, the fusing unit 40, the discharging unit 50, the exposure unit 60, and the transfer position control unit 70 may be provided inside the body 10.

The paper feeding unit 20 includes a feeding tray 21, on which a recording medium S is loaded, a pickup roller 22 configured to pick up the recording medium S, and a transfer roller 23 configured to deliver the recording medium S, which is picked up by the pickup roller 22, to the developing unit 30.

The developing unit 30 includes a photoconductor 31, an outer surface of which has an electrostatic latent image formed by the exposure unit 60, a charge roller 32 charging the photoconductor 31, four developers 33 each configured to develop an electro static image formed on the photoconductor 31 to a toner image by use of a yellow toner, a magenta toner, a cyan toner and a black toner, a transfer belt 34, a first transfer roller 35, and a second transfer roller 36. Hereinafter, when components need to be divided by colors, each component having a respective color is designated by placing symbols Y, M, C, and K representing yellow, magenta, cyan, and black, respectively, after its reference number.

The developer 33 includes a developing roller 37, which is configured to perform development on the electrostatic latent image formed on the photoconductor 31 by providing the electrostatic latent image with a toner, and a feed roller 38 which provides the developing roller 37 with a toner while rotating in contact with the developing roller 37.

The fusing unit 40 is configured to fuse a toner image to a paper by applying heat and pressure, and includes a heating roller 42 having a heat source 41, which applies heat to a paper having a tone, and a pressure roller 43, which is installed opposite the heating roller 42, and maintains a predetermined fusing pressure with respect to the heating roller 42.

Meanwhile, the paper discharging unit 50 includes a plurality of discharge rollers 51 that are sequentially installed to deliver a paper, which passes through the fusing unit 40, to the outside.

Hereinafter, an operation of the color image forming apparatus is described in brief. The exposure unit 60 scans light, for example, the light corresponding to yellow color image information, onto the photoconductor 31 charged with a predetermined potential by the charge roller 32, so that an electrostatic latent image corresponding to a yellow image is formed on the photoconductor 31. When a bias voltage for development is applied to the developing roller 37 of a yellow developer 33Y, a yellow toner is attached to the electrostatic latent image and thus a yellow toner image is formed. Such a toner image is transferred to the transfer belt 34 by the first transfer roller 35.

When the transferring of the yellow toner image corresponding to one page is completed, the exposure unit 60 scans light, for example, the light corresponding to magenta color image information onto the photoconductor 31, so that an electrostatic latent image corresponding to a magenta color image is formed.

A magenta developer 33M performs a developing by providing the electrostatic latent image with a magenta toner. A magenta toner image formed on the photoconductor 31 is transferred to the transfer belt 34 on top of the yellow toner image that has been previously transferred to the transfer belt 34.

Similarly, electrostatic latent images for cyan color and block color are formed and developed to a cyan toner image and a black toner image using a cyan developer 33C and a black developer 33K, respectively, and the cyan toner image and the black toner image are transferred to the transferred to the transfer belt 34. As a result, the yellow toner image, the magenta toner image, the cyan toner image, and the black toner image, are sequentially formed on the transfer belt 34 to form a color toner image.

The color toner image is transferred from the transfer belt 34 to a paper, such as the recording medium S, that passes through between the transfer belt 33 and the second transfer roller 36 and is fixed on the paper while passing through the fuser unit 40, and the paper passing through the fuser unit 40 may be discharged to an outside of the body 10 by the discharge roller 51.

Figure 2:
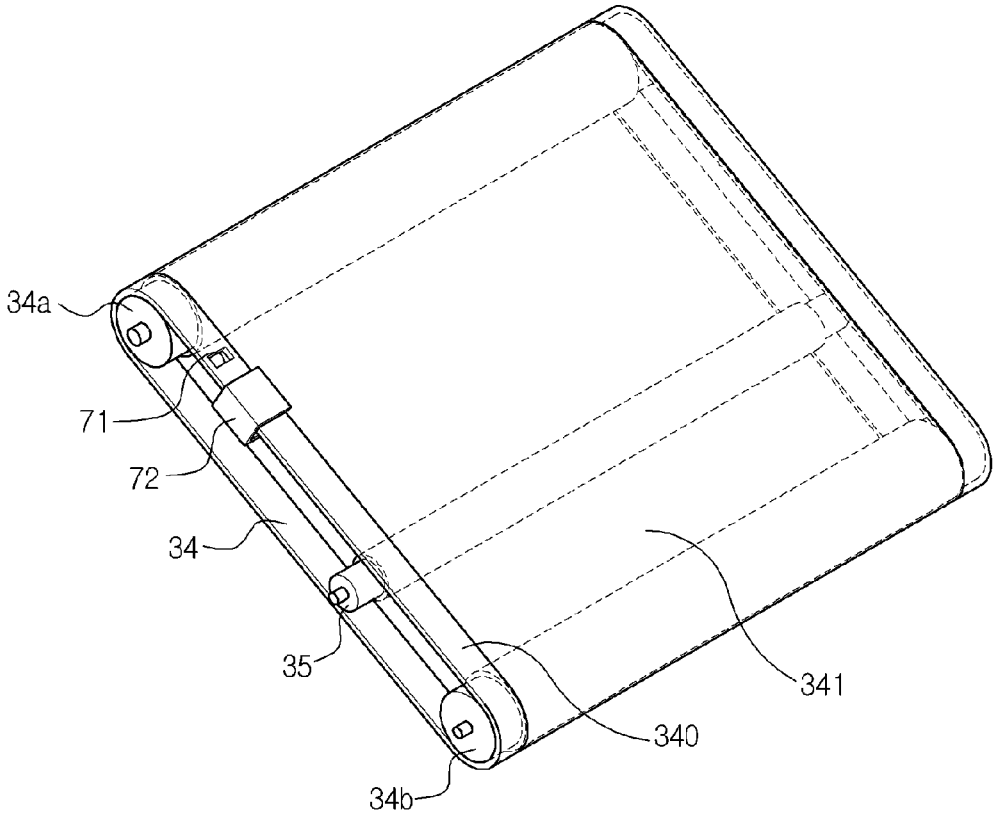
FIG. 2 is a perspective view illustrating a transfer belt of the color image forming apparatus of FIG. 1 according to an embodiment of the present general inventive concept.
Figure 3:
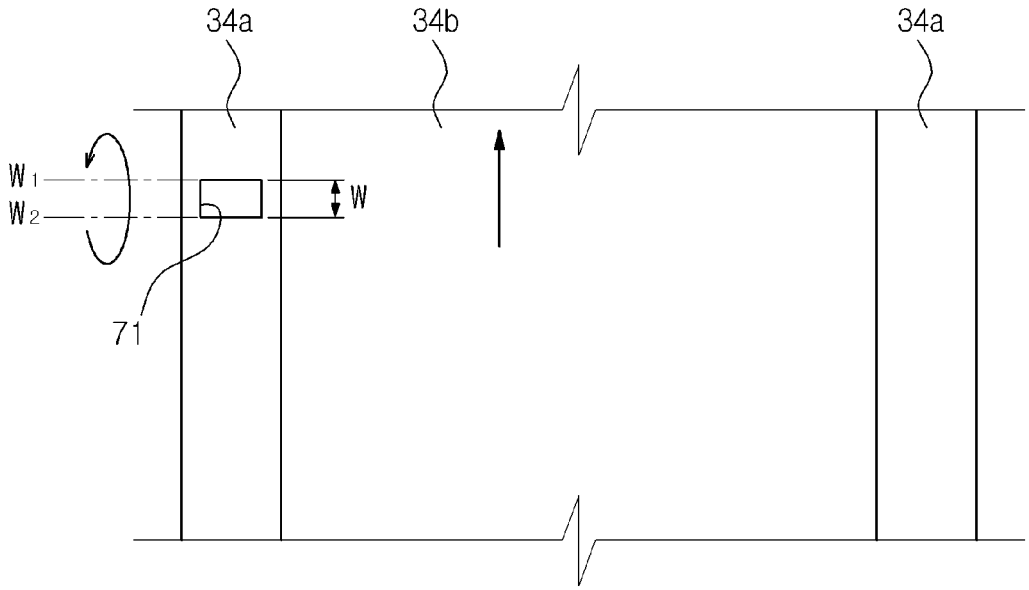
FIG. 3 is a plan view illustrating a position indicator formed on the transfer belt of FIG. 1 according to an embodiment of the present general inventive concept.

Referring to FIGS. 2 and 3, in order to enhance transferring efficiency, the transfer belt 34 may include a photo conductive layer 341 formed using polymer and a protection layer 340 formed along both edges of the photo conductive layer 341.

The transfer belt 34 is rotatably supported by a driven roller 34*a* and a driving roller 34*b*. The transfer belt 45 drives at a linear velocity of the photoconductor 31 while being supported by the driven roller 34*a* and the driving roller 34*b*.

The first transfer roller 35 is installed to face the transfer belt 34.

The first transfer roller 35 is connected to a first transfer bias voltage supply unit such that a predetermined first transfer bias voltage having an opposite polarity to a polarity of a toner (developer) is applied to the transfer belt 34.

The first transfer roller 35 applies the first transfer bias voltage to the transfer belt 34 such that the respective toner images formed on the surface of the photoconductor 31 are transferred to the transfer belt 34 on top of another, and form a primary transfer image as the color toner image.

The second transfer roller 36 is installed to face the transfer belt 34.

The second transfer roller 36 is connected to a second transfer bias voltage supply unit such that a predetermined second transfer bias voltage having an opposite polarity to a polarity of a toner is applied to the recording medium S.

The second transfer roller 36 applies the second transfer bias voltage to the recording medium S which is delivered by the feeding unit 20, such that the primary transfer image formed on the transfer belt 34 is transferred to the recording medium S.

The second transfer roller 36 is separated from the transfer belt 34 while the toner image is being transferred from the photoconductor 34 to the transfer belt 34, and makes contact with the transfer belt 34 with a predetermined pressure when the toner image is completely transferred to the transfer belt 34.

Referring to FIGS. 1 and 2, the transfer position control unit 70 includes a position indicator 71, a sensor 72, and a controller 73.

The position indicator 71 is formed on an edge of the transfer belt 34. The position indicator 71 is formed on the photo conductive layer 341 of the transfer belt 34 and may have a form of a slit or hole. The slit or hole may have a rectangular shape. The position indicator 71 may be formed on the protection layer 340 and/or the photo conductive layer 341 of the transfer belt 34.

Referring to FIG. 3, the position indicator 71 provided in the form of a rectangular hole has a front end W1 and a rear end W2 which are spaced apart by a width W in a rotation direction of the transfer belt 34. When each of the front end W1 and rear end W2 passes through the sensor 72, the sensor 72 generates an interrupt signal to represent a sensing signal.

The sensor 72 is disposed in a path along which the transfer belt 34 performs a circular movement. The sensor 72 may be disposed at a position to detect a plurality of signals corresponding to the position indicator 71 according to a movement of the position indicator 71 with respect to the sensor 72.

The sensor 72 includes a light passing sensor that includes a light emitting portion and a light receiving portion which are disposed on a moving path of the position indicator 71. The light emitting portion and the light receiving portion may be disposed opposite to each other with respect to the position indicator 71. The light emitting portion and the light receiving portion may be disposed opposite to each other with respect to an edge of the transfer belt 34 to detect the position indicator 71. The sensor 72 senses the position indicator 71 in a manner that the light receiving portion receives and senses light emitted from the light emitting portion when the position indicator 71 passes between the light emitting portion and the light receiving portion according to the rotation of the transfer belt 34.

The sensor 72 may generate an interrupt signal when detecting the position indicator 71 of the transfer belt 34 while the transfer belt 34 performs a circular movement at a predetermined speed in a clockwise direction, for example. The clockwise direction may be the rotation direction.

As the transfer belt 34 rotates, the sensor 72 generates a first interrupt signal corresponding to detecting of the front end W1 of the position indicator 71, and generates a second interrupt signal corresponding to detecting of the rear end W2 of the position indicator 71. The interrupt signals are input to the controller 73.

The sensor 72 may detect a plurality of transitions of a signal according to existence of the light reflected from the position indicator 71 when the sensor 72 has the light emitting portion and the light receiving portion. The plurality of transitions of the signal may be at least one of the first interrupt signal and the second interrupt signal. It is also possible that the transition of the signal may be noise generated from a structure, operational error, or characteristic of the signal thereof.

Although the sensor is illustrated as a light sensor. The present general inventive concept is not limited thereto. It is possible that the position indicator 71 may have a material or structure having at least two portions corresponding to the front end W1 and the rear end W2 to generate a magnetic field and that the sensor 72 may be a magnetic sensor to detect the magnetic field generated from at least two portions corresponding to the front end W1 and the second end W. The detected magnetic field may be converted into a plurality of transitions of a signal according to detection or existence of the magnetic field.

The controller 73 controls the overall operation of the color image forming apparatus. The controller is electrically connected to a driving unit of each component of the color image forming apparatus, and includes a microprocessor mounted on a circuit board that is fixed inside the body 10. In addition, the controller 73 includes a timer 74 connected to the microprocessor to supply a time signal to the microprocessor. The controller 73 may process one or more signals which are detected from the position indicator 17 along a time axis according to the time signal of the timer 74.

The controller 73 controls a transfer start position, at which toner images are transferred to the transfer belt 34 to form the primary color image, based on at least one electric signal which is output from the sensor 72 after a print command is generated and corresponds to the width W of the position indicator 71, when the toner images are formed on the photoconductor 31 by the yellow developer 33Y, the magenta developer 33M, the cyan developer 33C, and the black developer 33M.

The controller 73 receives the electrical signals, such as a first interrupt signal and a second interrupt signal, that are sequentially output from the sensor 72, calculates a time interval between the first interrupt signal and the second interrupt signal according to the time axis of the time signal of the timer 74, and determines whether each of the two interrupt signals is a signal generated according to detecting the front end W1 or the rear end W2 or a signal caused by noise, according to the calculated time interval between the first interrupt signal and the second interrupt signal. In this manner, it is determined that the position indicator 71 is detected.

Figure 4:
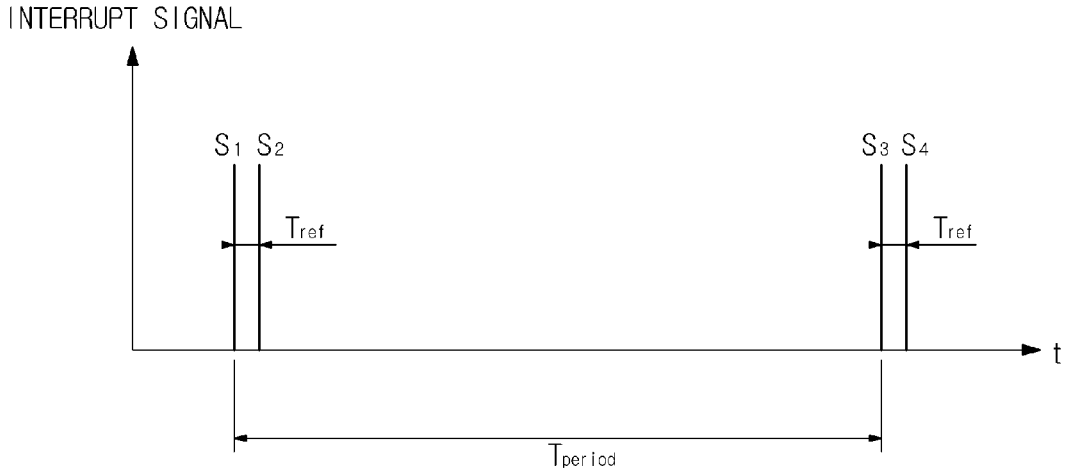
FIG. 4 is a timing diagram illustrating an example of a normal sensing signal obtained by detecting the position indicator at a sensor of the color image forming apparatus of FIG. 1.

FIG. 4 is a timing diagram illustrating an example of a normal sensing signal obtained by detecting the position indicator 71 at the sensor 72 of the color image forming apparatus of FIG. 1. Referring to FIG. 4, in a normal case that the sensor 72 detects the position indicator 71, the sensor 72 outputs a first interrupt signal S1 when detecting the front end W1 of the position indicator 71 and outputs a second interrupt signal S2 when sensing the rear end W2 of the position indicator 71. In this case, a time interval Tref corresponding to the width W of the position indicator 71 may be identical to the time interval between the first interrupt signal S1 and the second interrupt signal S2.

The first interrupt signal S1 and the second interrupt signal S2 having a time interval corresponding to the width of the position indicator 71 may be periodically detected at a period (Tperiod) of one rotation of the transfer belt 34.

Figure 5:
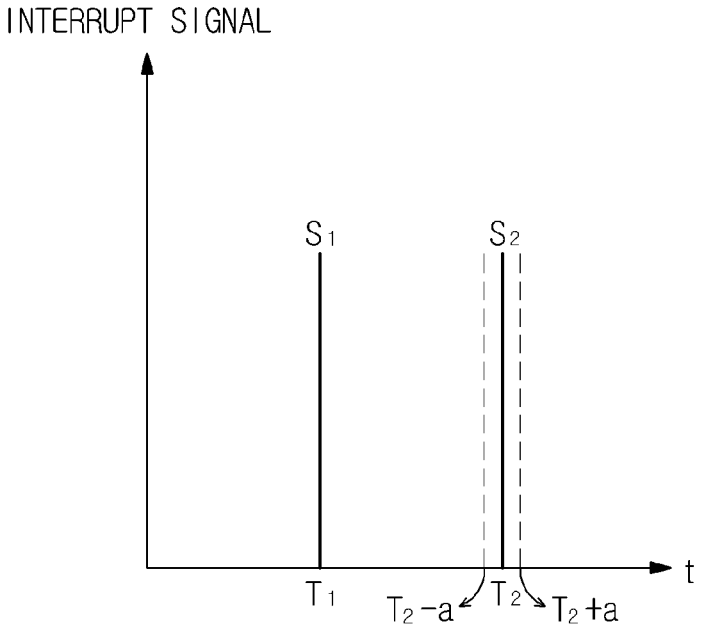
FIG. 5 is a diagram illustrating an example of an allowable margin for sensing signals S1 and S2 at a sensor of the color image forming apparatus of FIG. 1.

FIG. 5 is a diagram illustrating an example of an allowable margin of detected signals S1 and S2 at the sensor 72 of the color image forming apparatus of FIG. 1. Referring to FIG. 5, a time interval between a detecting time of the first interrupt signal S1 and each point of time allowing a margin "a" from a detecting time of the second interrupt signal S2 is regarded as the time interval Tref corresponding to the width W of the position indicator 71. The detecting time of the second interrupt signal S2 may be within the margin "a" of a time T2, that is, in a range between a time T−a and a time T+a, for example, When the time interval between the first interrupt signal S1 and the second interrupt signal S2 is identical to the time interval Tref corresponding to the width W of the position indicator, it is determined that the position indicator 71 is detected.

Figure 6:
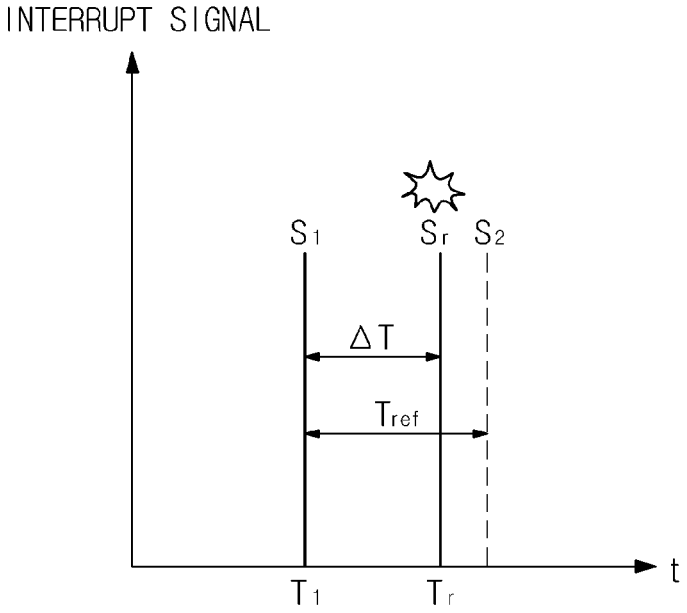
FIG. 6 is a diagram illustrating an example in which sensing signals have a time interval smaller than a predetermine value (Tref) at a sensor of the color image forming apparatus of FIG. 1.

Referring to FIG. 6, in a case that a first interrupt signal is S1, a second interrupt signal is Sr, and a reference interrupt signal, which is spaced apart from the first interrupt signal S1 by the time interval Tref corresponding to the width W of the position indicator 71, is S2, it is possible that a time interval ΔT between the first interrupt signal S1 and the second interrupt signal Sr is smaller than the time interval Tref corresponding to the width W of the position indicator 71. In this case, the second interrupt signal Sr is determined as noise.

Figure 7:
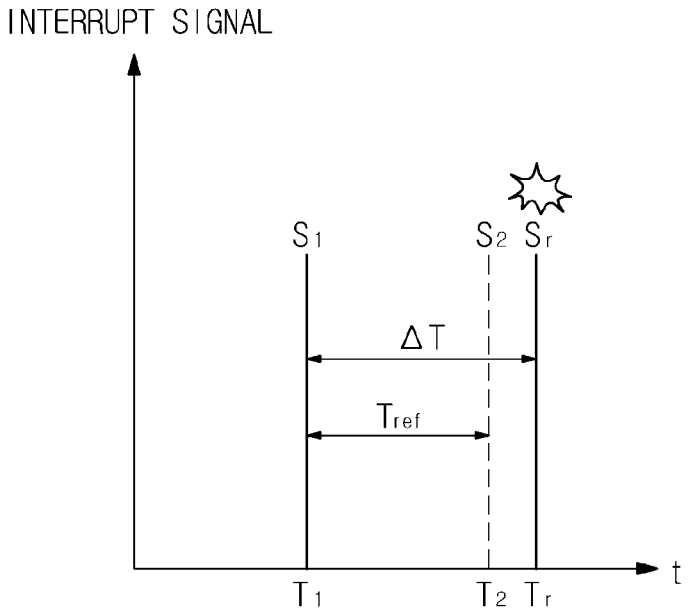
FIG. 7 is a diagram illustrating an example in which sensing signals have a time interval larger than a predetermine value (Tref) at a sensor of the color image forming apparatus of FIG. 1.

Referring to FIG. 7, when the time interval ΔT between the first interrupt signal S1 and the second interrupt signal Sr is larger than the time interval Tref corresponding to the width W of the position indicator 71, the second interrupt signal Sr may be changed to a first interrupt signal S1. The controller 73 may replace the first interrupt signal S1 with the second interrupt signal Sr. The controller 73 may treat the second interrupt signal Sr as the first interrupt signal S1. A current mode may be in a standby state (or standby mode) until a second interrupt signal is input. When the time interval ΔT between the first interrupt signal S1 and the second interrupt signal Sr is larger than the time interval Tref corresponding to the width of the position indicator 71, it is possible that the input first interrupt signal S1 may be an interrupt signal generated from the rear end W2 of the position indicator 71, or an interrupt signal may have missed between the first interrupt signal S1 and the second interrupt signal Sr.

In this manner, when the position indicator 71 of the transfer belt 34 is detected, the position indicator 71 is determined. Accordingly, the position indicator 71 is rapidly and reliably detected. A precise location of the position indicator 71 may be detected without being affected by the above described noise component and also be detected within a period of time shorter than a time taken for a rotation of the transfer belt 34.

Meanwhile, in a case that the position indicator 71 of the transfer belt 34 may be detached, damaged or deformed or the position indicator 71 of the transfer belt 34 is not in a position to be detected, the controller 73 may generate an alarming message to notify that the position indicator 71 is not detected is generated when the position indicator 71 is not determined using at least two interrupt signals from the position indicator 71 during the period Tperiod corresponding to one rotation of the transfer belt 34, thereby preventing the transfer belt 34 from moving continuously.

As described above, the controller 73 controls a transfer start position of a first toner image, for example, a yellow toner image, based on the signals generated by the sensor 72 when the front end W1 and the rear end W2 of the position indicator 71 are detected, respectively.

That is, after a print command is generated, the controller 73 receives a first sensing signal S1 and a second sensing signal S2, which have a time interval value corresponding to the width W of the position indicator 71, among signals output from the sensor 72 using the time signal of the timer 74.

A widthwise position of the transfer belt 34 in a direction corresponding to the width W of the position indicator 71 generating the first sensing signal S1 and/or the second sensing signal S2 is determined as the transfer start position of the yellow toner image according to the first sensing signal S1 and/or the second sensing signal S2 generated from the position location 71. The LSU 60 and the yellow developer 33Y are controlled such that a yellow electrostatic latent image and a yellow toner image are formed at an image forming start position of the photoconductor 31 corresponding to the determined transfer start position of the yellow toner image.

In this case, a point of time when a first color toner image, that is, a yellow electrostatic latent image, is formed on the photoconductor 31 by the LSU 60 is determined as a point of time at which the first sensing signal S1 or the second sensing signal S2 is generated by the sensor 72 through the position indicator 71 after the print command is generated.

A transfer start time when a yellow toner image formed on the photoconductor 31 starts to be transferred to the transfer belt 34 may be determined as a point of time at which the transfer start position of the transfer belt 34 for the yellow toner image reaches a transfer nip between the transfer belt 34 and the photoconductor 31, after the sensor 72 generates the first sensing signal S1 or the second sensing signal S2. The point of time may be determined when the controller 73 determines the first sensing signal S1 or the second sensing signal S2 upon receiving from the sensor 72.

Thereafter, as the transfer belt 34 and the photoconductor 31 rotate, when the transfer start position of the transfer belt 34 for the yellow toner image faces an image forming start position of the photoconductor 31 at a first transfer nip between the transfer belt 34 and the photoconductor 31, the controller 73 applies a first transfer bias voltage to the first transfer roller 35 through the first transfer bias voltage supply unit such that the yellow toner image formed on the photoconductor 31 is transferred to the transfer belt 34.

After the yellow toner image has been transferred from the photoconductor 31 to the transfer belt 34, the controller 73 determines a transfer start position for each of a magenta toner image, a cyan toner image, and a black toner image similar to the method of determining the transfer start position for the yellow toner image. Thereafter, the controller 73 controls the LSU 60 and the developers 33M, 33C, and 33K such that each of color electrostatic latent images and toner images is formed at the corresponding image forming start position of the photoconductor 31 corresponding to respective transfer start positions.

As described above, the controller 73 determines a transfer start position of the transfer belt 34 based on a first sensing signal and a second sensing signal having a time interval corresponding to the width W of the position indicator 71 among sensing signals output from the sensor 72, and controls related components such that a toner image is formed on the photoconductor 31 and the formed toner image is transferred to the transfer belt 34 according to the determined transfer start position.

Accordingly, even when a sensing signal output from the sensor 72 is a sensing signal caused by noise, since the position indicator 71 is detected without having to perform two rotations of the transfer belt 34, a standby time taken to the toner image is reduced, and the overall print time is significantly reduced.

The above description has been made in relation that the position indicator 71 is provided in the form of a rectangular hole. However, the position indicator 71 is not limited thereto. According to an example, the position indicator 71 may be implemented using a mark attached to one edge of the transfer belt 34.

In the case that the position indicator 71 is provided in the form of a rectangular hole, the sensor 72 may include a light passing sensor, which includes a light emitting portion and a light receiving portion disposed in the movement path of the position indicator 71 while interposing the position indicator 71 in between to sense the position indicator 71. Alternatively, in the case that the position indicator 71 is implemented as a mark, the sensor 72 may be a light reflection sensor. It is also possible that the position indicator 71 may be a reflecting element having one or more portions to reflect light corresponding to the first interrupt signal and the second interrupt signal.

Figure 8:
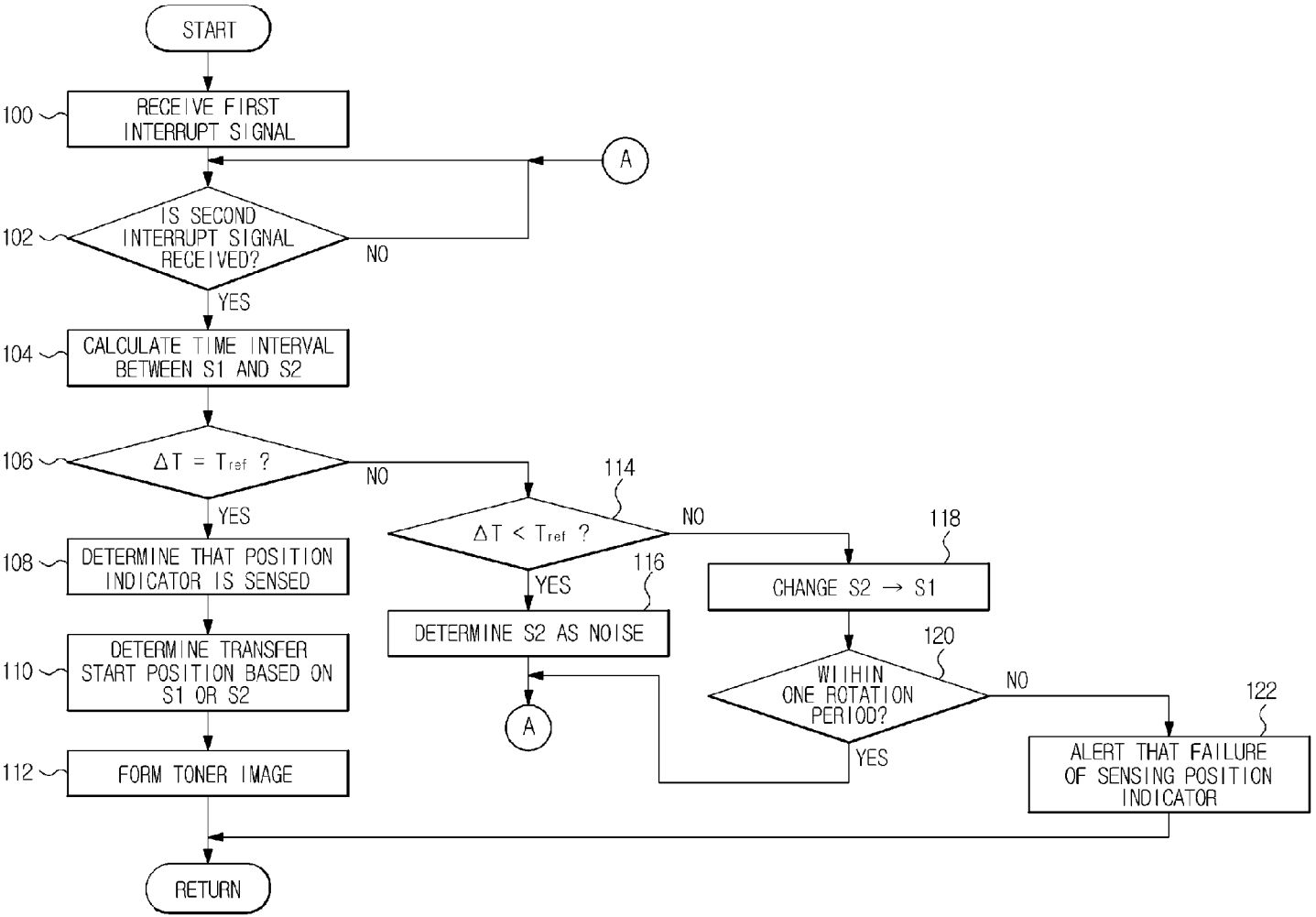
FIG. 8 is a flowchart illustrating an example of a control method of a color image forming apparatus according to an embodiment of the present general inventive concept.

FIG. 8 is a flowchart illustrating an example of a control method of a color image forming apparatus according to an embodiment of the present general inventive concept.

Referring to FIG. 8, the controller 73 receives a first sensing signal S1 to represent a first interrupt signal from the sensor 72 that outputs a sensing signal when the position indicator 71 is sensed at operation 100. After the first sensing signal S1 is received, the controller 73 determines whether a second signal S2 representing a second interrupt signal is received at operation 102.

When a result of the determination of operation 102 is that the second sensing signal S2 is received, the controller 73 calculates the time interval ΔT between the first sensing signal S1 and the second signal S2 at operation 104.

After the calculating of the time interval ΔT between the first sensing signal S1 and the second signal S2, the controller 73 determines the calculated time interval ΔT is a predetermined time interval Tref at operation 106.

When a result of the determination in operation 106 is that the calculated time interval ΔT is a predetermined time interval Tref, the controller 73 determines that the position indicator 71 is detected at operation 108.

The controller 73 determines a transfer start position of the transfer belt 34 based on the first sensing signal S1 and the second sensing signal S2 at operation 110. In this case, the transfer start position of the transfer belt 34 is a widthwise position of the transfer belt 34 corresponding to the position indicator 71 generating the first sensing signal S1. Alternatively, the transfer start position of the transfer belt 34 may be a widthwise position of the transfer belt 34 corresponding to the position indicator 71 generating the second sensing signal S2.

After the transfer start position is determined, the controller 73 forms a toner image on the photoconductor 31 according to the determined transfer start position at operation 112.

It is determined whether the calculated time interval ΔT is smaller than the predetermined time interval Tref at operation 114. When a result of the determination in operation 114 is that the calculated time interval ΔT is smaller than the predetermined time interval Tref, the second sensing signal is determined as noise at operation 116. The operation mode returns to operation 102.

When a result of the determination in operation 116 is that the calculated time interval ΔT is larger than a predetermined time interval Tref, the second sensing signal S2 is changed to the first sensing signal S1 at operation 118. After the second sensing signal S2 is changed to the first sensing signal S1, it is determined whether the transfer belt 34 has performed one rotation corresponding a time period Tperiod.

When the transfer belt 34 has not performed one rotation, the operation mode returns to operation 102. Meanwhile, when the transfer belt 34 has performed one rotation, the controller 73 determines that the position indicator 71 is not detected and alerts that failure of the sensing of the position indicator 71 to prevent the transfer belt 34 from continuously operating.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few embodiments of the present general inventive concept have been shown and described, it would be appreciated by those skilled in the art that changes may be made in these embodiments without departing from the principles and spirit of the general inventive concept, the scope of which is defined in the appended claims and their equivalents.

What is claimed is:

1. A color image forming apparatus comprising:

a transfer belt;

a position indicator provided on the transfer belt;

a sensor provided on a moving path of the position indicator, which moves when the transfer belt rotates, to detect the position indicator; and a controller configured to determine a transfer start position, at which a toner image is transferred from a photoconductor to the transfer belt, according to a sensing signal, which represents a width of the position indicator such that the toner image is formed on the photoconductor according to the determined transfer start position, wherein the sensor outputs a first sensing signal when a front end of the position indicator in a rotation direction of the transfer belt is detected, and outputs a second sensing signal when a rear end of the position indicator in the rotation direction of the transfer belt is detected, and wherein the controller determines one of the first sensing signal and the second sensing signal as noise when a time interval between the first sensing signal and the second sensing signal is not identical to a time corresponding to the width of the position indicator.

2. The color image forming apparatus of claim 1, wherein the position indicator comprises a slit or a hole formed through one side edge of the transfer belt.

3. The color image forming apparatus of claim 2, wherein the sensor comprises a light passing sensor comprising a light emitting portion and a light receiving portion.

4. The color image forming apparatus of claim 1, wherein the controller determines the first sensing signal and the second sensing signal as the sensing signal, which represents the width of the position indicator, when the time interval between the first sensing signal and the second sensing signal is identical to the time corresponding to the width of the position indicator.

5. The color image forming apparatus of claim 4, wherein the controller determines the transfer start position of the transfer belt when it is determined that the position indicator is sensed.

6. The color image forming apparatus of claim 5, wherein the controller determines a point of time, at which the first sensing signal is generated, or a point of time, at which the second sensing signal is generated, as the transfer start position of the transfer belt.

7. The color image forming apparatus of claim 1, wherein the controller determines the second sensing signal as noise when the time interval between the first sensing signal and the second sensing signal is smaller than the time corresponding to the width of the position indicator.

8. The color image forming apparatus of claim 7, wherein the controller receives a next sensing signal input from the sensor when the second sensing signal is determined as noise, and recognizes the next sensing signal as a second sensing signal when the next sensing signal is input from the sensor.

9. The color image forming apparatus of claim 1, wherein the controller determines the second sensing signal as the first sensing signal when the time interval between the first sensing signal and the second sensing signal is larger than the time corresponding to the width of the position indicator.

10. The color image forming apparatus of claim 9, wherein after the second sensing signal is changed to the first sensing signal, the controller receives a next sensing signal input from the sensor, and recognizes the next sensing signal as a second sensing signal when the next sensing signal is input from the sensor.

11. The color image forming apparatus of claim 9, wherein after the second sensing signal is changed to the first sensing signal, the controller determines whether the transfer belt has performed one rotation, and when a result of determination is that the transfer belt has performed one rotation, the controller determines the changed first sensing as a noise.

12. The color image forming apparatus of claim 11, wherein the controller alerts that the sensing of the position indicator is failed when the changed first signal is determined as noise.

13. A color image forming apparatus comprising:

a photoconductor on which a toner image is formed;

a transfer belt configured to deliver the toner image formed on the photoconductor such that the toner image is transferred to a recording medium;

a position indicator provided on the transfer belt;

a sensor which is provided on a moving path of the position indicator, which moves when the transfer belt rotates, and detects the position indicator; and a controller configured to determine a transfer start position, at which the toner image formed on the photoconductor is transferred to the transfer belt, according to a sensing signal which represents a width of the position indicator, and such that the toner image is formed on the photoconductor according to the determined transfer start position, wherein the sensor outputs a first sensing signal when a front end of the position indicator in a rotation direction of the transfer belt is detected, and outputs a second sensing signal when a rear end of the position indicator in the rotation direction of the transfer belt is detected, and wherein the controller determines one of the first sensing signal and the second sensing signal as noise when a time interval between the first sensing signal and the second sensing signal is not identical to a time corresponding to the width of the position indicator.

14. The color image forming apparatus of claim 13, wherein the controller determines the first sensing signal and the second sensing signal as the sensing signal, which represents the width of the position indicator, when the time interval between the first sensing signal and the second sensing signal is identical to the time corresponding to the width of the position indicator.

15. The color image forming apparatus of claim 14, wherein the controller determines a point of time, at which the first sensing signal is generated, or a point of time, at which the second sensing signal is generated, as the transfer start position of the transfer belt, when it is determined that the position indicator is sensed.

16. The color image forming apparatus of claim 13, wherein the controller determines the second sensing signal as noise when the time interval between the first sensing signal and the second sensing signal is smaller than the time corresponding to the width of the position indicator, receives a next sensing signal input from the sensor when the second sensing signal is determined as a noise, and recognizes the next sensing signal as the second sensing signal when the next sensing signal is input from the sensor.

17. The color image forming apparatus of claim 13, wherein the controller determines the second sensing signal as the first sensing signal when the time interval between the first sensing signal and the second sensing signal is larger than the time corresponding to the width of the position indicator, receives a next sensing signal input from the sensor, and recognizes the next sensing signal as the second sensing signal when the next sensing signal is input from the sensor.

18. The color image forming apparatus of claim 17, wherein after the second sensing signal is changed to the first sensing signal, the controller determines whether the transfer belt has performed one rotation, and when a result of the determination is that the transfer belt has performed one rotation, the controller determines the changed first sensing as a noise and alerts that the sensing of the position indicator is failed.

19. A color image forming apparatus comprising:

a photoconductor;

an exposure unit configured to form an electrostatic latent image on the photoconductor;

a developing unit configured to form the electrostatic latent image formed on the photoconductor to a toner image;

a transfer belt configured to deliver the toner image formed on the photoconductor such that the toner image is transferred to a recording medium;

a position indicator provided on a transfer belt;

a sensor configured to sense the position indicator when the transfer belt rotates, wherein the sensor outputs a first sensing signal when a front end of the position indicator in a rotation direction of the transfer belt is detected, and outputs a second sensing signal when a rear end of the position indicator in the rotation direction of the transfer belt is detected; and a controller configured to determine whether the position indicator is detected based on a sensing signal representing a width of the position indicator, and to perform control on the exposure unit such that an electrostatic latent image is formed based on the sensing signal when a result of the determination is that the position indicator is detected, wherein the controller determines one of the first sensing signal and the second sensing signal as noise when the time interval between the first sensing signal and the second sensing signal is not identical to the time corresponding to the width of the position indicator.

20. A control method of a color image forming apparatus, the control method comprising:

detecting a position indicator provided on a transfer belt through a sensor;

comparing a time corresponding to a width of the position indicator with a time interval between a first sensing signal, which is generated when the sensor detects a front end of the position indicator, and a second sensing signal, which is generated when the sensor detects a rear end of the position indicator;

controlling a transfer start position, at which a toner image is transferred from a photoconductor to the transfer belt, based on a point of time the first sensing signal is generated or a point of time the second sensing signal is generated according to a result of the comparing; and determining one of the first sensing signal and the second sensing signal as noise when the result of the comparing is that a time interval between the first sensing signal and the second sensing signal is not identical to a time corresponding to the width of the position indicator.

21. The control method of claim 20, further comprising:

determining the second sensing signal as noise when the result of the comparing is that the time interval between the first sensing signal and the second sensing signal is smaller than the time corresponding to the width of the position indicator;

receiving a next sensing signal input from the sensor when the second sensing signal is determined as noise; and recognizing the next sensing signal as the second sensing signal when the next sensing signal is input from the sensor.

22. The control method of claim 21, wherein the comparing of the time comprises comparing a time interval between the first sensing signal and the recognized second sensing signal with the time corresponding to the width of the position indicator.

23. The control method of claim 21, further comprising:

changing the second sensing signal to the first sensing signal;

determining whether the transfer belt has performed one rotation, and alerting that the sensing of the position indicator is failed when a result of the determination is that the transfer belt has performed one rotation.

24. The control method of claim 20, further comprising:

changing the second sensing signal to the first sensing signal when a result of the comparison is that the time interval between the first sensing signal and the second signal is larger than the time corresponding to the width of the position indicator;

receiving a next sensing signal input from the sensor; and recognizing the next sensing signal as the second sensing signal when the next sensing signal is input from the sensor.

25. The control method of claim 24, wherein the comparing of time comprises comparing a time interval between the first sensing signal and the recognized second sensing signal with the time corresponding to the width of the position indicator.

26. The control method of claim 20, wherein the controlling of the transfer start position comprising:

determining that the position indicator is sensed when a result of the comparison is that the time interval between the first sensing signal and the second sensing signal is identical to the time corresponding to the width of the position indicator; and controlling the transfer start position, at which the toner image is transferred to from the photoconductor to the transfer belt, based on the point of time the first sensing signal is generated or the point of time the second sensing signal is generated.

27. The control method of claim 26, wherein the controlling of the transfer start position comprising:

determining a transfer start position, at which the toner image is transferred from the photoconductor to the transfer belt, based on the point of time the first sensing signal is generated or on the point of time the second sensing signal is generated;

starting to form a toner image on an image forming position of the photoconductor corresponding to the determined transfer start position; and transferring the toner image formed on the photoconductor to the transfer belt when the transfer start position of the transfer belt reaches the photoconductor.

* * * * *

UNITED STATES PATENT AND TRADEMARK OFFICE

CERTIFICATE OF CORRECTION

PATENT NO. : 9,170,519 B2
APPLICATION NO. : 13/542832
DATED : October 27, 2015
INVENTOR(S) : Jung Woo Son et al.

It is certified that error appears in the above-identified patent and that said Letters Patent is hereby corrected as shown below:

IN THE CLAIMS

Claim 22, Column 17, Lines 28-29

Delete "comparing of" and insert --comparing--, therefor.

Signed and Sealed this
Second Day of February, 2016

Michelle K. Lee

Michelle K. Lee
*Director of the United States Patent and Trademark Office*